US005401206A

United States Patent [19]

Majors

[11] Patent Number: 5,401,206

[45] Date of Patent: Mar. 28, 1995

[54] VIBRATORY FINISHING MACHINE HAVING A TUB WITH ELONGATED TROUGHS

[75] Inventor: Curtis O. Majors, West Chester, Ohio

[73] Assignee: Rosemont Industries, Inc., Cincinnati, Ohio

[21] Appl. No.: 142,210

[22] Filed: Oct. 25, 1993

[51] Int. Cl.[6] ..... B24B 31/033

[52] U.S. Cl. ..... 451/326; 451/113; 451/104

[58] Field of Search ..... 51/163.1, 7, 17, 6; 451/326, 113, 104, 74

[56] References Cited

U.S. PATENT DOCUMENTS

| | | | |
|---|---|---|---|
| Re. 27,084 | 3/1971 | Balz | 51/163 |
| 2,009,126 | 7/1935 | Wettlaufer | 51/163.1 |
| 2,143,610 | 1/1939 | Muller . | |
| 2,200,724 | 5/1940 | Robins | 74/87 |
| 2,208,077 | 7/1940 | Linke | 83/9 |
| 2,222,777 | 11/1940 | Linke . | |
| 2,387,140 | 10/1945 | Fruth | 51/2 |
| 2,389,337 | 11/1945 | Zademach | 134/66 |
| 2,882,024 | 4/1959 | Behrens et al. | 259/1 |
| 3,045,397 | 7/1962 | Hesslenberg | 51/7 |
| 3,071,900 | 1/1963 | Balz | 51/163 |
| 3,074,068 | 1/1963 | Balz | 51/163.1 |
| 3,093,940 | 6/1963 | Balz | 51/163 |
| 3,100,088 | 8/1963 | Podmore et al. | 241/170 |
| 3,103,086 | 9/1963 | Balz | 51/163 |
| 3,161,993 | 12/1964 | Balz | 51/163 |
| 3,161,997 | 12/1964 | Balz | 51/316 |
| 3,191,348 | 6/1965 | Rampe | 51/163.1 |
| 3,253,369 | 5/1966 | Reichert et al. | 51/163 |
| 3,328,922 | 7/1967 | Ruppe | 51/163.1 |
| 3,336,701 | 8/1967 | Moore | 51/7 |
| 3,400,495 | 9/1968 | Balz | 51/163 |
| 3,423,884 | 1/1969 | Balz | 51/163 |
| 3,435,564 | 4/1969 | Balz | 51/163 |
| 3,466,815 | 9/1969 | Balz | 51/313 |
| 3,541,738 | 11/1970 | Rampe | 51/163 |
| 3,552,068 | 1/1971 | Fossen | 51/163 |
| 3,579,919 | 5/1971 | Jones | 51/163 |
| 3,624,970 | 12/1971 | Balz | 51/163 |
| 3,643,379 | 2/1972 | Testolin | 51/6 |
| 3,643,384 | 2/1972 | Isaacson et al. | 51/163.1 |
| 3,680,266 | 8/1972 | Shiplov | 51/163 |
| 3,871,135 | 3/1975 | Anderson | 51/163 |
| 3,893,266 | 7/1975 | Anderson et al. | 51/163 |
| 4,025,419 | 5/1977 | Musschoot | 209/3 |
| 4,059,926 | 11/1977 | Rampe | 51/163.1 |
| 4,077,162 | 3/1978 | Balz | 51/163.1 |
| 4,301,625 | 11/1981 | Rampe | 51/163.2 |
| 4,499,692 | 2/1985 | Balz | 51/313 |
| 4,569,156 | 2/1986 | Yoder | 51/163.1 |
| 4,676,027 | 6/1987 | McNeil | 51/7 |
| 4,693,037 | 9/1987 | McNeil | 51/163.2 |
| 4,747,695 | 5/1988 | Schmidt | 366/291 |

FOREIGN PATENT DOCUMENTS

| | | | |
|---|---|---|---|
| 0130536 | 1/1985 | European Pat. Off. | 51/163.1 |
| 2067261 | 7/1981 | United Kingdom | 51/163.1 |
| 0795905 | 1/1981 | U.S.S.R. | 51/163.1 |
| 1042965 | 9/1983 | U.S.S.R. | 51/163.1 |

*Primary Examiner*—Robert A. Rose
*Attorney, Agent, or Firm*—Steven J. Rosen

[57] ABSTRACT

A surface finishing vibratory apparatus and method for using such to simultaneously surface finish a plurality of elongated parts with loose particulate finishing media. The apparatus includes a single tub having a plurality of transversely disposed longitudinally extending troughs wherein the troughs are isolated from each other such that finishing media and the workpieces placed in each trough cannot move to another trough during the surface finishing process. The troughs mat use fixed or removable compartment walls that divide one or more of the troughs into separate isolated compartments to use for shorter workpieces.

9 Claims, 2 Drawing Sheets

VIBRATORY FINISHING MACHINE HAVING A TUB WITH ELONGATED TROUGHS

BACKGROUND OF THE INVENTION

1. Field of the Invention

The present invention relates generally to vibratory finishing machines and more particularly to tubs for such machines that can process several elongated parts or workpieces simultaneously.

2. Description of Related Art

Vibratory finishing machines are conventionally employed for the surface finishing, such as deburring or polishing for example, of parts or workpieces. Such workpieces may be made of metal, plastic, wood, or the like, but the present invention has particular applications for metal. The surface finishing process is conventionally carried out by placing a workpiece in a tub of a vibratory machine or apparatus. The workpiece or workpieces, if a plurality of workpieces are to be processed simultaneously, are generally submerged in finishing media in the tub and the tub is then vibrated for a period of time. The term finishing media is generally defined for the purpose of this patent as a loose and particulate material which is used to impart all types of finishes. Such finishing media materials generally include abrading materials, polishing materials, and materials that are suitable for polishing, abrading, deburring, edge-breaking, buffing, burnishing, scrubbing, and the like. The finishing media, more specifically, includes materials which serve as loose, particulate, and solid finishing materials of the type presently employed in the trade and others of a similar nature, whether natural or synthetic, including stone, porcelain, abrasive-filled clays, plastics, ceramics, wood, leather, cobmeal, or the like, and in any suitable shape or form as may be suitable.

The prior art is replete with vibratory finishing machines and methods of employing the same for the surface finishing of parts or workpieces. Representative U.S. Patents in this field include Balz U.S. Pat. No. 3,161,993 of Dec. 22, 1964, the corresponding U.S. Pat. No. Re. 27,084 of Mar. 2, 1971, and U.S. Pat. No. 3,624,970 of Dec. 7, 1971. One particular type of vibratory finishing machine designed for use on elongated parts or workpieces is disclosed in U.S. Pat. No. 4,569,156 entitled "Vibratory Finishing Apparatus" which issued on Feb. 11, 1986. The drawback with such a machine is that it can only handle one piece at a time or one piece in each compartment. Such an apparatus and method is time consuming and costly. In order to process larger quantity of pieces more machines and often more operators are required thereby increasing costs associated with such processes.

There is a need for a vibratory finishing machine for the simultaneous vibratory surface finishing of a plurality of elongated parts or workpieces in a single tub of one machine. Moreover, there is a need for the elongated workpieces to be isolated from each other so as to prevent entanglement of and banging between the workpieces. It is apparent that the prior art leaves much to be desired from the standpoint of providing a vibratory finishing machine which is capable of finishing several elongated parts or workpieces at the same time without scuffing or damaging the workpieces. Such shortcomings of the prior art are remedied by the present invention which provides a vibratory surface finishing apparatus and the finishing method which allows the fast, safe, efficient, and cost saving surface finishing of elongated parts or workpieces.

OBJECTS OF THE INVENTION

It is accordingly an object of the present invention to provide a vibratory finishing machine which is particularly adapted for simultaneously surface finishing a plurality of elongated parts with loose particulate finishing media in a single tub.

It is another object to provide a tub which is particularly adapted for use in such a surface finishing machine or apparatus.

It is a further object of the invention to provide a novel method for the simultaneous vibratory surface finishing of a plurality of elongated workpieces.

A further object of the present invention is to provide an apparatus and method for using such an apparatus to simultaneously surface finish a plurality of elongated workpieces in a more efficient and cost effective manner than is available in the prior art.

Another object of the present invention is to provide a versatile apparatus and method for using such an apparatus to simultaneously surface finish a plurality of both elongated workpieces and shorter workpieces in a more efficient and cost effective manner than is available in the prior art.

Additional objects and advantages will be apparent to one skilled in the art and still other advantages and object will become apparent hereinafter.

SUMMARY OF THE INVENTION

The present invention provides a surface finishing vibratory apparatus and method for simultaneously surface finishing a plurality of elongated parts with loose particulate finishing media. The apparatus includes a single tub having a plurality of transversely disposed longitudinally extending troughs wherein the troughs are isolated from each other such that finishing media and the workpieces placed in each trough cannot move to another trough during the surface finishing process. One particular embodiment includes fixed compartment walls that divide one or more of the troughs into separate isolated compartments and another embodiment has removable compartment walls.

The vibratory finishing apparatus of the present invention includes a vibratory means operable for generating a vibratory motion in the finishing media when it is disposed within said troughs, and an isolating means for preventing the workpieces from moving from one to another of the troughs. One embodiment of the invention provides a vibratory means having at least one tub vibrating means suitably mounted to the tub and at least one motor means drivingly connected to the tub vibrating means. The vibratory means, in one embodiment, provides a single motor drivingly connected to a plurality of the tub vibrating means wherein each of the tub vibrating means includes a shaft journalled to the tub and with an eccentric weight carried on the shaft. The present invention also provides a means for rotatably driving the shaft which in one embodiment includes a pulley externally mounted on the shaft and drivenly connected to the motor by a belt.

Another embodiment of the present invention provides a means to resiliently suspend the tub up from a support frame that extends upwardly from a base to which the motor is mounted. One type of resilient means contemplated by the present invention is a plurality of coiled springs.

Another embodiment of the present invention provides a tub having a liner, which can be made of a material such as steel or urethane, disposed over a tub frame wherein the tub frame is made of steel or some other suitable material.

Yet another embodiment of the present invention provides that at least one of the plurality of longitudinally extending elongated troughs is a compartmentalized having a plurality of longitudinally disposed compartment walls that separate the compartmentalized trough into compartments designed to hold individual workpieces. In one embodiment the compartment walls are fixed while an alternate the compartment walls are removable.

The present invention also provides for different types of finishing media disposed in different troughs of the tub of the present invention.

The present invention also provides a method for surface finishing a plurality of workpieces in a vibratory finishing apparatus for surface finishing in accordance with the present invention which includes the steps of placing a plurality of workpieces in compartments of the apparatus having finishing media therein and in a ratio of one workpiece to one compartment and operating the apparatus to generate a vibratory motion of the finishing media to surface finish the workpieces. One particular method of the present invention provides for the surface finishing of elongated workpieces in a ratio of one workpiece to one trough while an alternate embodiment uses a finishing apparatus of the present invention having a plurality of longitudinally extending compartmentalized troughs having a plurality of longitudinally disposed walls that separate the compartmentalized trough into compartments designed to hold individual workpieces.

The foregoing, and other features and advantages of the present invention, will become more apparent in the light of the following description and accompanying drawing.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
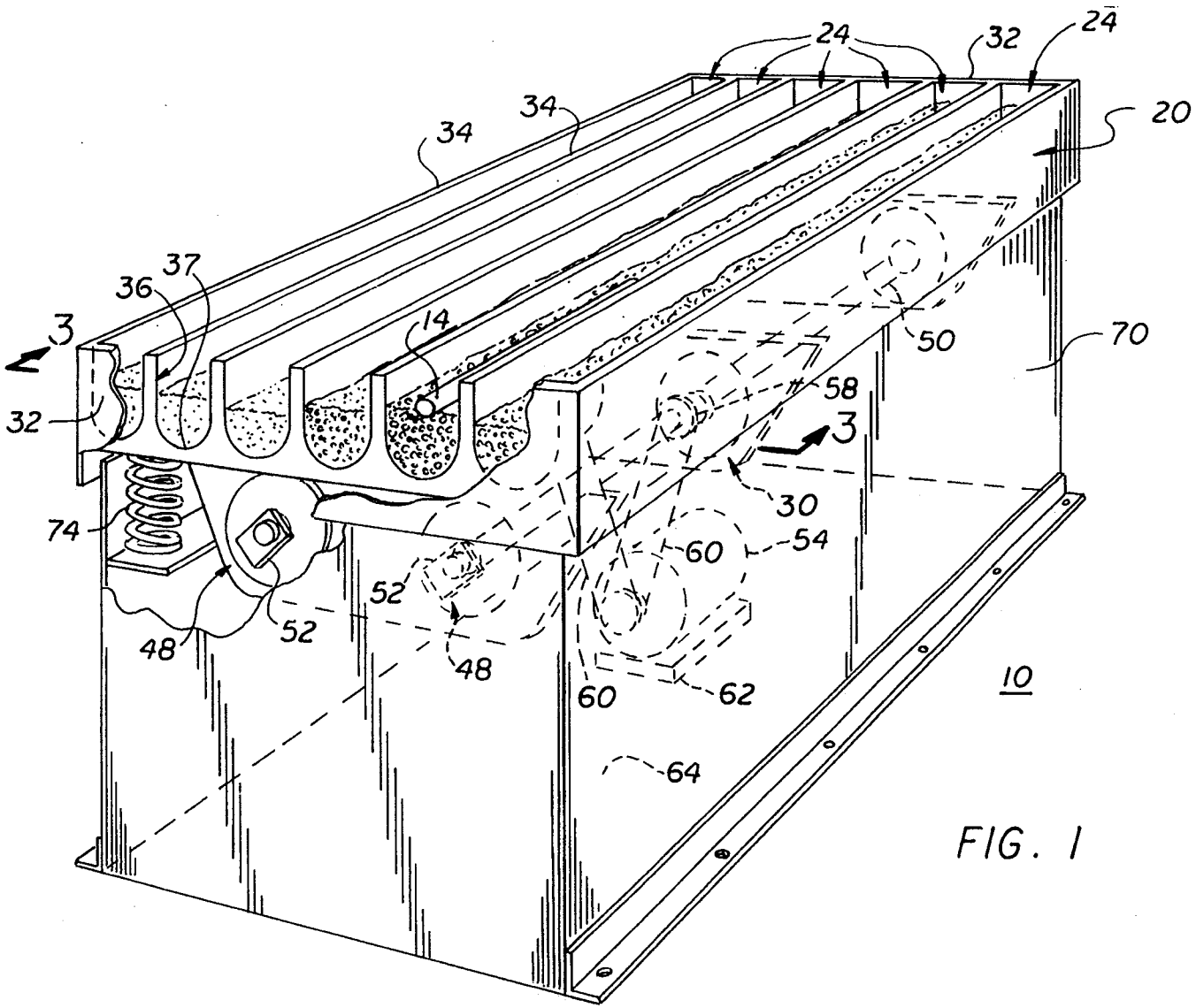
FIG. 1 is a partial cut-away perspective view of a surface finishing vibratory apparatus in accordance with an exemplary embodiment of the present invention.

Illustrated schematically in FIG. 1 is a surface finishing vibratory apparatus 10 for simultaneously surface finishing a plurality of elongated parts or workpieces 14, as illustrated by a gun barrel, with loose particulate finishing media 18. The apparatus includes a single tub 20 having a plurality of transversely disposed longitudinally extending troughs 24 (illustrated as 5 in troughs in FIG. 1) wherein the troughs are isolated from each other such that finishing media 18 and the workpieces 14 placed in each trough cannot move to another trough during the surface finishing process. A vibration means 30 is provided for vibrating the tub 20 and its troughs 24 in unison to cause a minute vibratory motion between the workpieces 14 and the finishing media 18 within the troughs 24 and further cause the finishing media 18 to move en masse in an orbital motion about longitudinal axes 26 of the troughs.

An isolating means for preventing the workpieces 14 and preferably media 18 from moving from one trough 24 to another trough is provided by constructing the tub 20 with upwardly extending side walls 32 which serve as end walls for the longitudinal ends of the troughs and are no higher than longitudinally extending trough walls 34. The trough walls 34 and side walls 32 do not have to be the same height as long as they are sufficiently sized so as to prevent the workpieces 14 from moving from one trough 24 to another trough. A U-shaped cross-section 36 of the troughs 24 provides another isolating means for preventing the workpieces 14 and preferably media 18 from moving from one trough to another trough. The U-shaped cross-section 36 is characterized by trough walls 34 generally extending upward from a semi-circular trough bottom 37.

Figure 2:
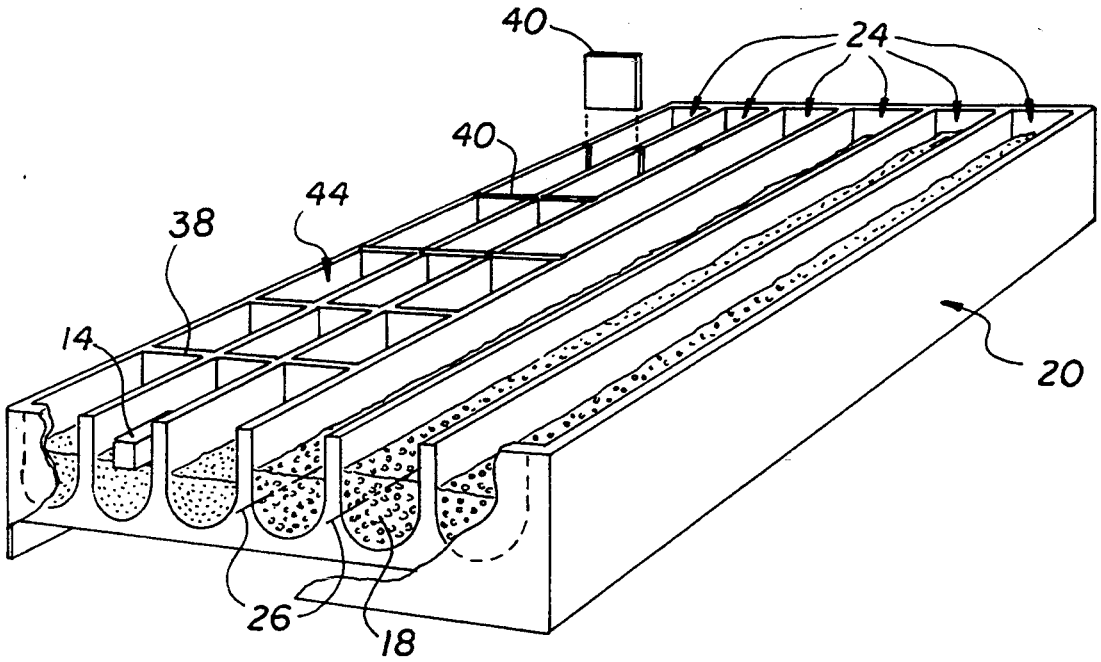
FIG. 2 is a perspective view of an alternate tub for a surface finishing vibratory apparatus in accordance with the present invention.

Illustrated in FIG. 2 is an alternate embodiment of the tub 20 and includes longitudinally disposed fixed compartment walls 38 or removable compartment walls 40 or a combination of the two types of compartment walls that divide one or more of the troughs 24 into separate isolated compartments 44. This provides an additional dimension of versatility to the present invention by allowing the present invention to be used for simultaneously surface finishing many different sized workpieces 14. This embodiment provides for vibrating the tub 20 and its troughs 24 in unison so as to cause a minute vibratory motion between the workpieces 14 and the finishing media 18 and cause the finishing media 18 to move an en masse in an orbital motion about the longitudinal axes 26 of the troughs within the compartments 44.

Referring back to FIG. 1, the vibration means 30 of the exemplary embodiment includes two tub vibrating means 48 in the form of a shaft 50 journalled to the tub 20 and an rotatable eccentric weight 52 carried on the shaft. A motor means 54 is drivingly connected to each of the tub vibrating means 48 by a pulley 58 externally mounted on the shaft 50 and drivenly connected to the motor means 54 by a belt 60. The motor means 54 is mounted to a base 62 which is designed to rest on a shop floor 64 in the exemplary embodiment illustrated in FIG. 1 but the present invention contemplates that the motor means may be mounted elsewhere such as directly on the tub 20. The present invention also contemplates that the motor means may be such as directly on the tub 20 and have the rotatable eccentric weight 52 directly mounted to or connected to the motor means 54 with or without the shaft 50 journalled to the tub.

A support frame 70 designed to rest on the shop floor extends upwardly from the base 62 upon tub 20 is resiliently suspended upward from which the motor means 54 is mounted. FIG. 1 illustrates one means to resiliently suspend the tub 20 upwardly from the support frame 70. It is a plurality of coiled springs 74 disposed at the four corners of the tub 20. Other number of coils may be used and other resilient materials that are well known in the field may be used to suspend the tub 20 from the support frame 70. For example a tub could be suspended downwardly into a support frame by elastomeric material bands or blocks.

Figure 3:
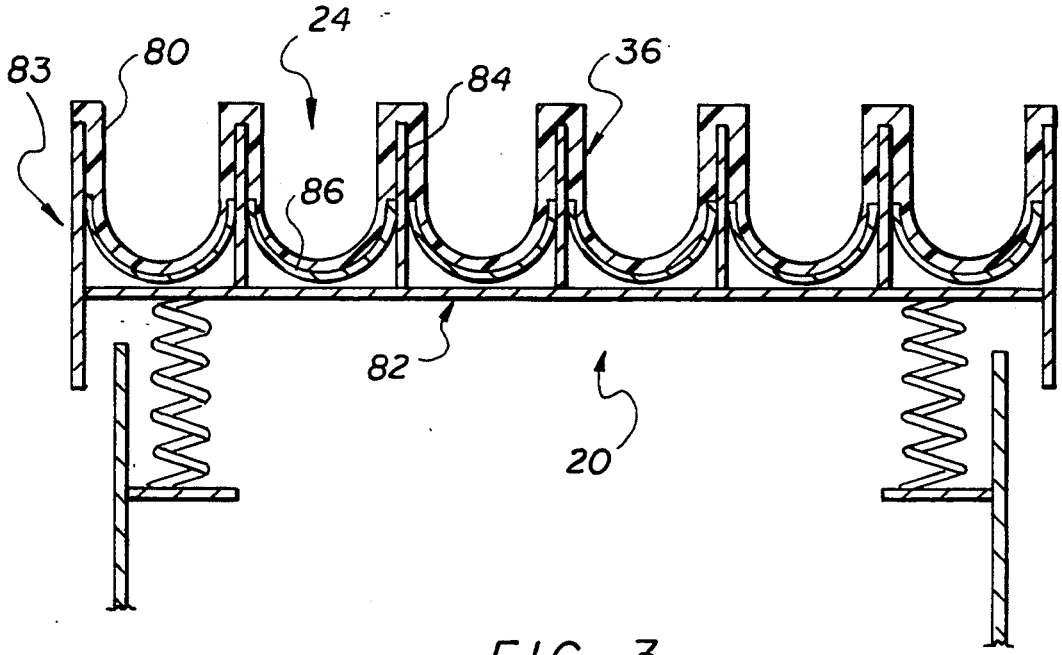
FIG. 3 is a cross-sectional view of the tub and its frame through 3—3 in FIG. 1.

Illustrated in FIG. 3 is one embodiment of the present invention which provides the tub 20 with a liner 80 disposed over a tub frame 82. Preferably the tub frame 82 is made of steel or some other suitable material and the liner 80 of a material suitable to a particular application. The liner material could be, though not limited to, steel, urethane, or fiberglass. The tub frame 82 provides a stiff skeleton 83 of the troughs 24 in the form of a plurality of transversely disposed straight skeletal walls 84 upwardly mounted from a frame bottom 82 and having semi-circular skeletal bottoms 86. The liner 80 has a shape that conforms to fit over and be supported by the skeleton 83 and to form the U-shaped cross-section 36 of the troughs 24 of the tub 20. Though many trough 24 cross-sectional shapes are suitable for use in the present invention the U-shaped is particularly advantageous because of its straight sides which helps isolate the workpieces and its semi-circular bottoms which help promote minute vibratory motion between the workpieces and the finishing media within and further cause the finishing media to move an en masse in an orbital motion about longitudinal axes of the troughs.

The present invention also provides a method for surface finishing a plurality of workpieces in a vibratory finishing apparatus for surface finishing constructed in accordance with the present invention as illustrated in FIGS. 1–3. The method includes the steps of placing a plurality of workpieces in compartments of the vibratory finishing apparatus having finishing media therein. For the purposes of this invention the troughs are considered individual compartments if they are not compartmentalized by compartment walls. The workpieces are loaded into the compartments in a ratio of one workpiece to one compartment and the apparatus is operated to generate a vibratory motion of the finishing media to surface finish the workpieces.

One particular method of the present invention provides for the surface finishing of elongated workpieces in a ratio of one workpiece to one trough wherein each of the troughs are a single compartment. An alternate embodiment uses a finishing apparatus in accordance with the present invention that has a plurality of longitudinally extending compartmentalized troughs with a plurality of longitudinally disposed walls that separate the compartmentalized trough into compartments designed to hold individual workpieces. The present invention also provides for the use of different types of finishing media disposed in different troughs of the tub of the present invention.

While the preferred embodiment of the invention has been described fully in order to explain its principles, it is understood that various modifications or alterations may be made to the preferred embodiment without departing from the scope of the invention as set forth in the appended claims.

I claim:

1. A vibratory finishing apparatus for surface finishing a plurality of workpieces with suitable finishing media, said apparatus comprising;

a tub comprising a tub liner disposed over and supported by a skeletal tub frame;

said tub liner having an open top and a transversely disposed plurality of longitudinally extending elongated troughs open to said top;

said troughs having upwardly extending side walls at longitudinal ends of each of said troughs;

a vibratory means operable for generating a vibratory motion in the finishing media when it is disposed within said troughs, said vibratory means comprising at least one tub vibrating means suitably mounted to said tub frame and at least one motor means drivingly connected to said tub vibrating means; and an isolating means for preventing the workpieces from moving from one of said troughs to another of said troughs, said isolating means comprising said troughs having U-shaped cross-sections with longitudinally extending trough walls extending upwardly from a generally semi-circular trough bottom and said side walls extending upwardly to said open top of said tub liner.

2. The apparatus of claim 1 wherein at least one of said plurality of longitudinally extending elongated troughs is a compartmentalized trough having a plurality of longitudinally disposed compartment walls that separate said compartmentalized trough into compartments designed to hold individual workpieces.

3. The apparatus of claim 1 wherein said tub frame is attached to said support frame by a resilient means.

4. The apparatus of claim 3 wherein said resilient means is a plurality of coiled springs.

5. The apparatus of claim 1 wherein different types of finishing media are disposed in different ones of said troughs.

6. The apparatus of claim 1 wherein said vibratory means comprises a single one of said motor means drivingly connected to a plurality of said tub vibrating means wherein each of said tub vibrating means comprises a shaft journalled to said tub and carrying an eccentric weight.

7. The apparatus of claim 6 wherein said vibratory means further comprises a means for rotatably driving said shaft including a pulley means externally mounted on said shaft and drivenly connected to said motor means by a belt means.

8. The apparatus of claim 7 wherein said tub is resiliently suspended up from a support frame that extends upwardly from a base and said motor means is mounted to said base.

9. The apparatus of claim 8 having only two of said tub vibrating means.

* * * * *